US006531938B1

(12) United States Patent
Smith et al.

(10) Patent No.: US 6,531,938 B1
(45) Date of Patent: Mar. 11, 2003

(54) REMOTE OPERATED CIRCUIT BREAKER MODULE

(75) Inventors: Joseph R. Smith, Unionville, CT (US); Gurdev Singh Bains, Wolcott, CT (US)

(73) Assignee: Carling Technologies, Plainville, CT (US)

( * ) Notice: Subject to any disclaimer, the term of this patent is extended or adjusted under 35 U.S.C. 154(b) by 0 days.

(21) Appl. No.: 09/710,018

(22) Filed: Nov. 10, 2000

(51) Int. Cl.[7] ..... H01H 75/00
(52) U.S. Cl. ..... 335/14; 335/68; 335/20
(58) Field of Search ..... 335/8–10, 14, 335/20, 202, 68, 71, 72; 200/50.01–50.1

(56) References Cited

U.S. PATENT DOCUMENTS

RE19,753 E * 11/1935 Graves, Jr. et al. ..... 335/20
3,646,487 A * 2/1972 Brackett, Sr. ..... 335/8
4,167,716 A * 9/1979 Horn ..... 335/14
4,990,873 A * 2/1991 Grunert et al. ..... 335/68
5,557,082 A * 9/1996 Leet et al. ..... 335/9

* cited by examiner

*Primary Examiner*—Lincoln Donovan
(74) *Attorney, Agent, or Firm*—McCormick, Paulding & Huber LLP

(57) ABSTRACT

A remote operated circuit breaker assembly has at least one circuit breaker, a remote module for remotely operating the circuit breaker and an actuator tie pin. Each circuit breaker includes a circuit breaker enclosure of generally rectangular shape having one side and an opposing side, and a circuit breaker actuator link pivotally mounted inside the circuit breaker enclosure. The remote module includes a module housing mounted to the one side of the circuit breaker enclosure and having a shape generally congruent with the circuit breaker enclosure. A motor is disposed in the module housing, a module actuator is pivotally mounted inside the module housing and a gear means couples the motor to the module actuator. The actuator tie pin connects the circuit breaker actuator link to the module actuator within the interior of the circuit breaker enclosure and the module housing. The actuator tie pin is received in aligned slots defined by the abutting circuit breaker enclosure side and module housing side.

10 Claims, 6 Drawing Sheets

REMOTE OPERATED CIRCUIT BREAKER MODULE

FIELD OF THE INVENTION

The present invention relates generally to circuit breakers. More specifically, the present invention relates to a remotely operated circuit breaker module for attachment to the side of a circuit breaker to provide remote actuation of the circuit breaker.

BACKGROUND OF THE INVENTION

Remote operated circuit breaker modules (remote modules) are frequently combined with circuit breakers and panel mounted in control panel systems to provide remote operated circuit breakers. Remote operation of circuit breakers, e.g., opening, closing or resetting, are often desirable to perform such functions as service, diagnostics, load shedding, and power distribution, in areas that are unsafe or difficult to access.

Remote modules may be either a side mounted type, which mounts to the side of a standard circuit breaker housing, or a top mounted type, which mounts over the circuit breakers top, i.e., front face.

However, space is a premium in enclosures of control panel systems and prior art top mounted motor modules disproportionately increase the overall depth required of an enclosure in order to accommodate the remote module/circuit breaker assembly. That is, when the top mounted remote module is mounted to the panel of a control panel system, the circuit breaker is cantilevered off of the back of the remote module and extends deep into the enclosure by a distance equal to the combined height of the remote module and circuit beaker. Use of the top mounted remote module will often interfere with existing components in the enclosure, e.g., the system bus bar. Additionally, the cantilevered circuit breaker puts added stress on the remote module and often requires extra support blocks to prevent damage. This is especially problematic in the case of multipole circuit breakers or circuit breakers having heavy gauge wires.

Typically, remote modules of the side-mounted type are operatively connected to a circuit breaker with one or more poles associated therewith to form a remote operated circuit breaker assembly. The remote operated circuit breaker assembly is typically use to provide protection for a circuit having one or more phases. Alternatively, the remote module may also be used to remotely operate a plurality of circuit breakers stacked together, each protecting a separate circuit, which are required to be actuated simultaneously.

The circuit breakers of the above described prior art remote operated circuit breaker assembly typically include left and right half shells forming a split case enclosure which encloses the interior components of a pole of the circuit breaker. A circuit breaker with multiple poles will have an enclosure for each pole stacked together to form the circuit breaker. Each pole includes a circuit breaker actuator link having a handle extending out of the top of each enclosure, which is pivotally mounted to the interior of each enclosure. A handle tie kit passes through a hole located in the upper portion of each handle to operatively tie the handles together and to provide actuation of all the poles substantially simultaneously. Load and line (or source) terminals extend through opposing end portions of the bottom of each enclosure and are spaced to align with load and line bus bars of a typical control panel system respectively.

The prior art side mounted remote module of the above described remote operated circuit breaker assembly typically includes a module housing, which is open on one side, and a module motor disposed in the module housing. The open side of the module housing abuts against one of the outer half-shells of the circuit breaker and is fastened thereto to enclose the motor therein. That is, the outside surface of either the left or right half shell of the circuit breaker is stacked against the module housing to function as the inside surface of the enclosure for the prior art remote module. A module actuator is operatively associated with the module motor and includes a module handle which extends out of the top of the remote module. The handle tie kit also passes through a hole located in the upper portion of the module handle to operatively tie the module handle to the circuit breaker handles and to provide remote actuation of the circuit breaker. An electrical terminal, for providing power to the remote module, extends through an end portion of the bottom of the remote module substantially in line with either the line or load terminals of the circuit breaker poles.

However, because the prior art module housing must rely on the left or right half shell of the circuit breaker to form an enclosure, prior art side mounted remote modules can only be mounted on one side of the circuit breaker and must be hard fastened, e.g., riveted, to the circuit breaker at the factory. Additionally, the prior art remote modules cannot be utilized as stand alone retrofit kits for installation to existing circuit breakers in the field. Therefore, any retrofitting to remotely operated circuit breakers in the field would involve removal and replacement of existing manually operated circuit breakers.

Also, the prior art remote module handle actuates each pole of the circuit breaker by applying a torsional pressure to the circuit breaker handles through the handle tie kit at substantially a single point, i.e., the through hole in the upper portion of each handle. However, the torsion on the handle tie kit results in an actuation lag between the farthest (far pole) and nearest poles (near pole) relative to the remote module. That is the pole farthest from the remote module will close last when remotely actuated. This causes greater arcing on the contacts of the far pole with respect to the near pole, resulting in a respectively greater rate of ware to the contacts of the far pole. The actuation lag becomes more pronounce as the number of poles involved increases.

Additionally, because the electrical terminal of the prior art remote module extends out of the bottom of its enclosure substantially in line with the load or line terminals, the electrical terminal of the remote module often interferes with the load or line bus bars of a typical control panel system. This requires notches to be cut in the bus bars, thus resulting in an increased cost and a reduced current carrying capacity of the bus bars.

Accordingly, there is a need for an improved remote operated circuit breaker module for attachment to the side of a circuit breaker.

SUMMARY OF THE INVENTION

In an exemplary embodiment of the present invention a remote operated circuit breaker assembly is presented comprising at least one circuit breaker, a remote module for remotely operating the circuit breaker and an actuator tie pin. Each circuit breaker includes a circuit breaker enclosure of generally rectangular shape having one side and an opposing side, and a circuit breaker actuator link pivotally mounted inside the circuit breaker enclosure. The remote module includes a module housing mounted to the one side of the circuit breaker enclosure and having a shape generally congruent with the circuit breaker enclosure. A motor is disposed in the module housing, a module actuator is pivotally mounted inside the module housing and a coupling means couples the motor to the module actuator. The actuator tie pin connects the circuit breaker actuator link to the module actuator within the interior of the circuit breaker enclosure and the module housing. The actuator tie pin is received in aligned slots defined by the abutting circuit breaker enclosure side and module housing side.

In an alternative embodiment of the invention, the circuit breaker enclosure of the remote operated circuit breaker also has a top and the circuit breaker actuator link has a circuit breaker handle extending out of the top of the circuit breaker enclosure. An upper portion of the circuit breaker handle has a handle hole disposed therethrough. The module housing of the remote module has a top and the module actuator has a module handle extending out of the top of the module housing. An upper portion of the module handle has a module hole disposed therethrough. A handle tie kit, which passes through the handle hole and the module hole, operatively ties the handles together.

In another alternative embodiment of the invention, the remote operated circuit breaker also includes a limit switch. The limit switch has a limit switch actuator with a closed position for enabling rotation of the motor in a first direction and an open position for enabling rotation of the motor in an opposing second direction. The closed and open positions have a predetermined distance therebetween. Additionally, a limit switch lever is selectively located at a first position for retaining the limit switch actuator in the closed position, and is selectively located at a second position for retaining the limit switch actuator in the open position.

DETAILED DESCRIPTION OF THE PREFERRED EMBODIMENTS

Figure 1:
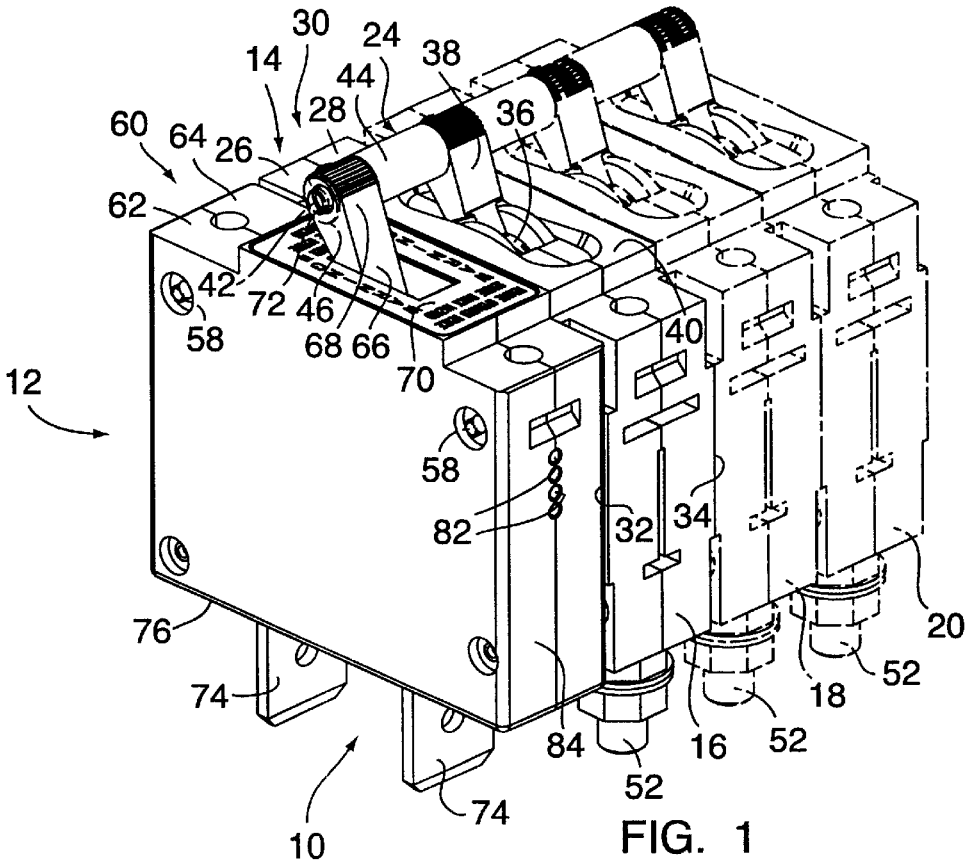
FIG. 1 is a perspective view of the remote operated circuit breaker assemble in accordance with the present invention.
Figure 2:
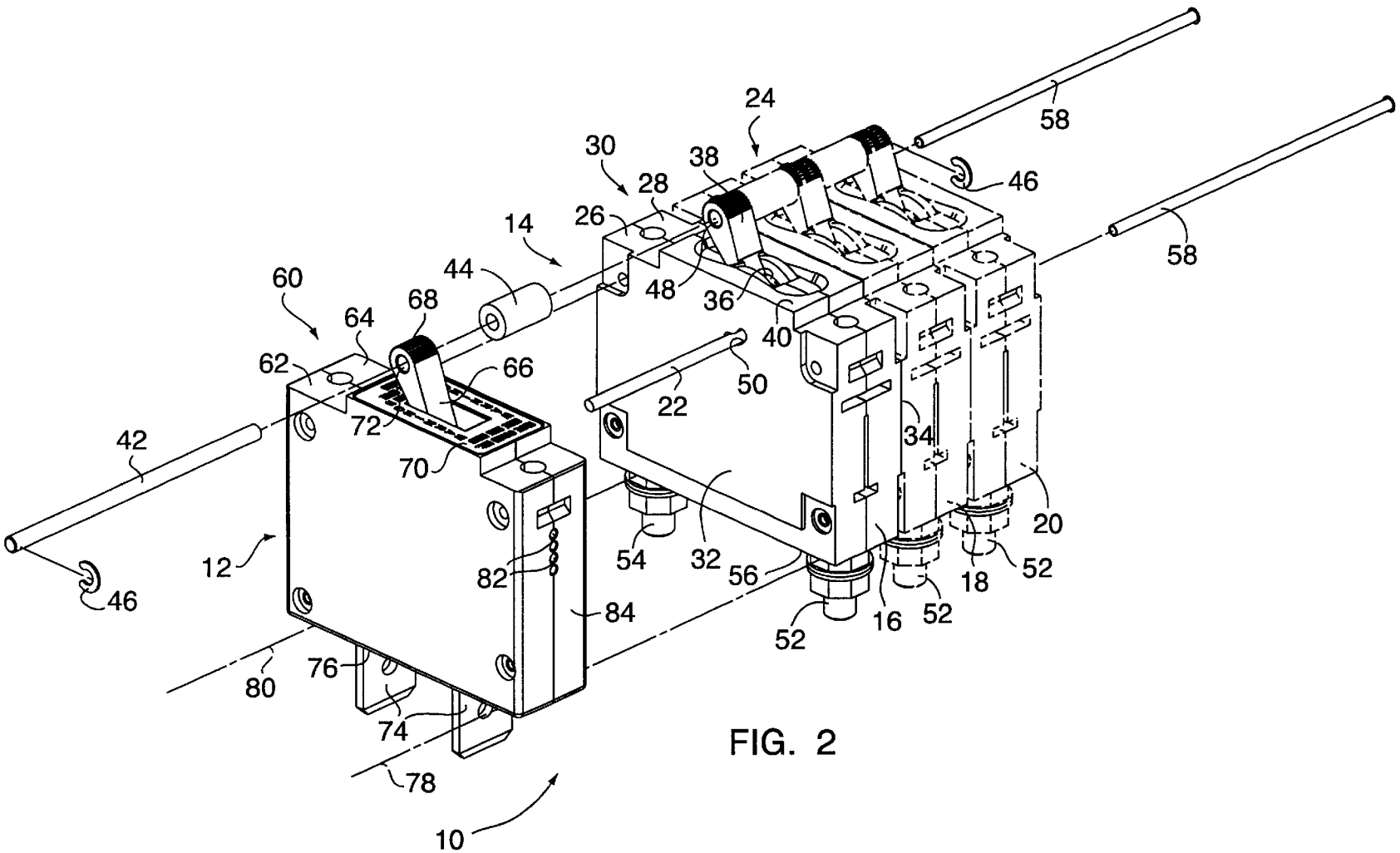
FIG. 2 is an exploded view of the remote operated circuit breaker assembly of FIG. 1.

Referring to FIGS. 1 and 2, an exemplary embodiment of a remote operated circuit breaker assembly in accordance with the present invention is shown generally at 10. The remote operated circuit breaker assembly 10 includes a remote module 12 and a circuit breaker 14. The circuit breaker 14 has at least one pole 16, but may also include additional poles 18 and 20 (shown in phantom form) stacked together to form a multi-pole circuit breaker. As will be discussed in greater detail hereinafter, the remote module 12 and the circuit breaker 14 are operatively connected via an actuator tie pin 22 and a handle tie kit 24 to provide two-point remote actuation of the remote operated circuit breaker assembly 10. The two-point actuation advantageously reduces actuation lag of the far pole 20 with respect to the near pole 16.

Each pole 16, 18 and 20 of the circuit breaker 14 includes a left half shell 26 and a right half shell 28 engaging each other to form a split case circuit breaker enclosure 30 of generally rectangular shape having one side 32 and an opposing side 34, which encloses the interior components of the circuit breaker 14. Each pole 16, 18 and 20 includes a circuit breaker actuator link 36 pivotally mounted inside the circuit breaker enclosure having a circuit breaker handle 38 extending out of a top 40 of the enclosure 30. The handle tie kit 24 includes a handle pin 42, a handle spacer 44 and a pair of handle clips 46. The handle pin 42 passes through a handle hole 48 located in the upper portion of each circuit breaker handle 38 of each pole, 16, 18 and 20 to operatively tie the handles together and to provide actuation of all the poles substantially simultaneously. The actuator tie pin 22 connects to the circuit breaker actuator link 36 within the interior of the circuit breaker enclosure 30 through a generally kidney shaped slot 50 to also provide actuation of all poles substantially simultaneously. Line terminal 52 and load terminal 54 extend through opposing end portions of a bottom 56 of the enclosure 30 and are spaced to align with load and line bus bars (not shown) of a typical control panel system respectively. Rivets 58 stack the poles 16, 18 and 20 together and fasten them to the remote module 12.

The remote module 12 includes a module housing 60 mounted to the one side 32 of the circuit breaker enclosure 30 of pole 16 and having a shape generally congruent with the circuit breaker enclosure 30. The module housing 60 includes a left shell 62 and a right shell 64 engaged together to form a split case module housing 60 which encloses the interior components of the remote module 12. The remote module 12 includes a module actuator 66 pivotally mounted inside the module housing 60 having a module handle 68 extending out of a top 70 of the module housing 60. The handle tie kit also passes through a module handle hole 72 located in an upper portion of the module handle 68 to operatively tie the module handle 68 to the circuit breaker handles 38, and to provide remote actuation of the circuit breaker 14 via the remote module 12.

Though the circuit breaker handle 38 and the module handles 68 are shown in alignment, one skilled in the art would recognize that they may also be offset. Additionally, one recognized in the art would recognize that the handle tie kit 24 may also accommodate offset handles.

A pair of electrical spade terminals 74 for providing power to the remote module 12, extends out of a central portion of a bottom 76 of the module housing 60. The electrical terminals 74 are located intermediate a pair of axes 78 and 80 extending substantially perpendicular from the one side 32 of the circuit breaker enclosure 30 and passing through the line 52 and load 54 terminals respectively. Advantageously, the electrical terminals 74 do not interfere with load and line bus bars (not shown) of a typical control panel system that are spaced to connect to the line 52 and load 54 terminals of the circuit breaker 14. Though the electrical terminals 74 are illustrated as spade terminals in this embodiment, one skilled in the art would recognize that other types of terminals may also be used, e.g., socket terminals or terminals within a connector. Additionally, a plurality of wire lead through holes 82 are disposed on an upper portion of a rear rim 84 of the module housing 60 to provide access for connecting power leads (not shown) in lieu of the electrical terminals 74.

Figure 3:
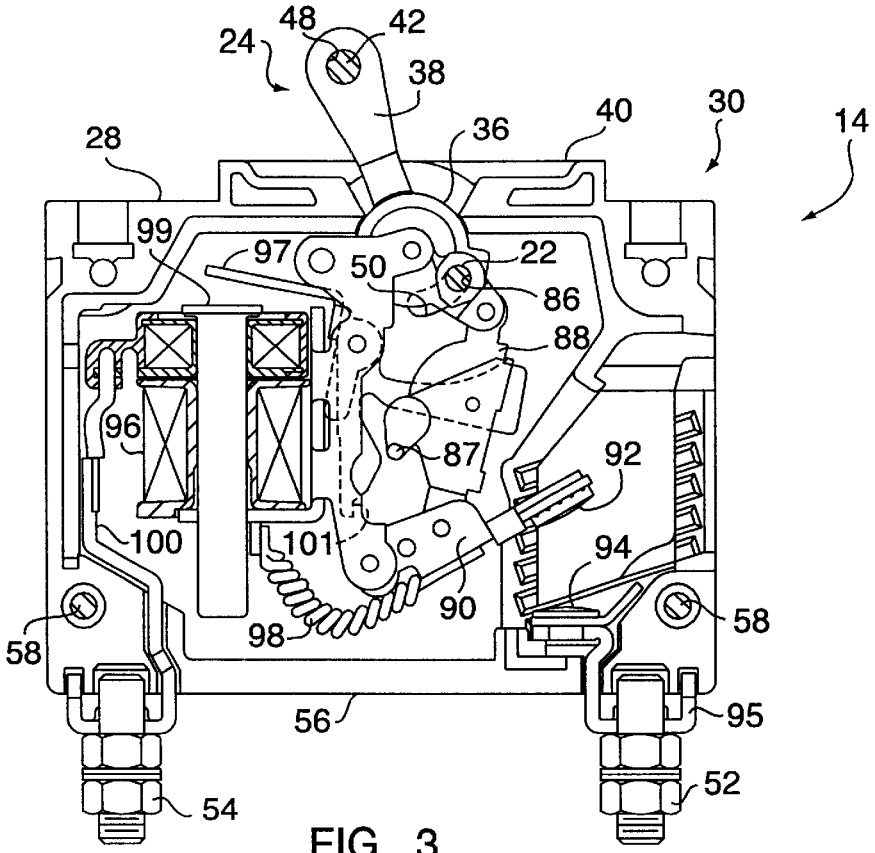
FIG. 3 is a perspective view of the interior of the circuit breaker of FIG. 1 with the moveable contact lever in the open position.
Figure 4:
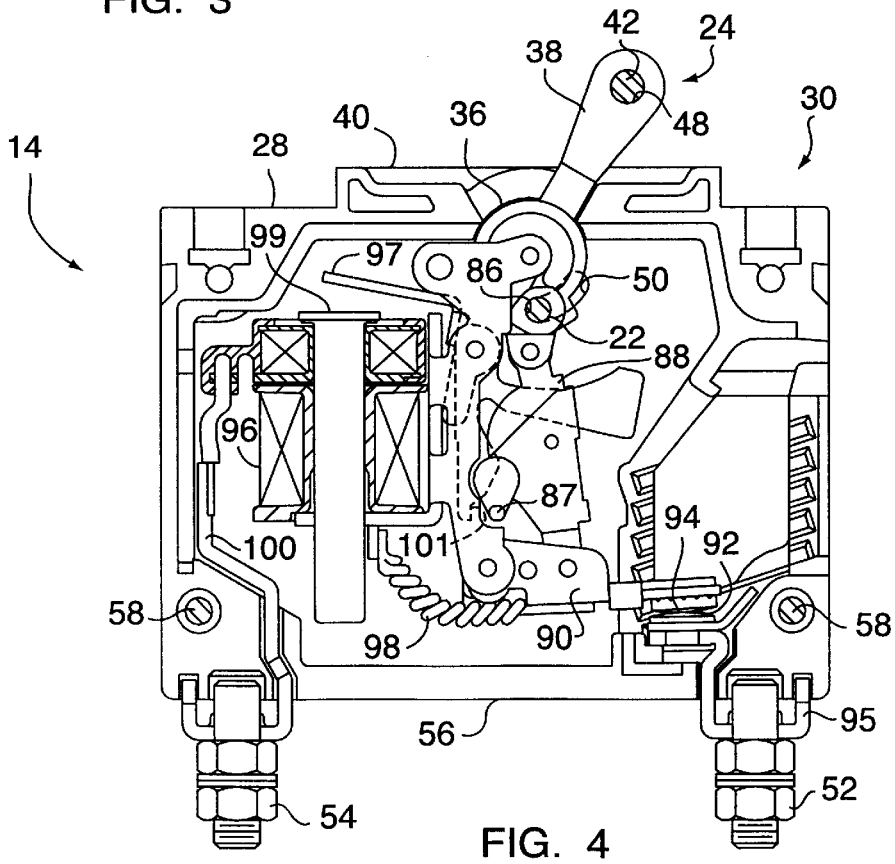
FIG. 4 is a perspective view of the interior of the circuit breaker of FIG. 1 with the moveable contact lever in the closed position.

Referring to FIGS. 3 and 4, the circuit breaker actuator link 36 of each pole 16, 18 and 20 of circuit breaker 14 includes the circuit breaker handle 38 and a link tie pin hole 86 disposed on the actuator link 36 inside of the circuit breaker enclosure 30. The actuator tie pin 22 (see in FIG. 2) passes through the kidney shaped slot 50 and the link tie pin hole 86 to connect to the circuit breaker actuator link 36 within the interior of the circuit breaker enclosure 30 of each pole 16, 18 and 20 to operationally tie the poles together.

The actuator link 36 is pivotally connected to one end of a collapsible linkage assembly 88 and the other end of the collapsible linkage assembly 88 is pivotally connected to a moveable contact lever 90. The moveable contact lever 90 includes a moveable contact 92 disposed thereon which traverses from an open position to a closed position to make electrical contact with a stationary contact 94. Typically, when the moveable contact lever is in the closed position, a current will flow through terminal 52 to the stationary contact 94 via lead 95. The current is conducted through the stationary contact 94, through the movable contact 92 and lead 98 to the coil 96 and out through lead 100 and terminal 54. When the current in the coil 96 exceeds a predetermined rated current capacity, the coil 96 will cause armature 97 to move down onto pole piece 99. Armature 97 has a depending leg 101 that engages pin 87 to collapse the collapsible linkage assembly 88 and to allow the contact lever 90 to be biased to the open position.

The circuit breakers or poles 16, 18 and 20 are each provided with toggle type actuator links 36 that are linked by pins 42 and spacers 44, i.e., handle tie kits 24. However, theses handle tie kits can be eliminated in some installations because the present invention provides an alternative arrangement for linking the poles 16,18 and 20 internally to the motorized remote module 12 as will be described in greater detail hereinafter.

The poles 16, 18 and 20 preferably each include a current sensing magnetic coil 96, one skilled in the art would recognize that not every pole may include a current sensing device. Additionally, one skilled in the art would recognize that the circuit breaker actuator link 36 of each pole may not include a circuit breaker handle 38. Additionally, one skilled in the art would also recognize that more than one circuit breaker 14 may be operated by the remote module 12. A second circuit breaker assembly might be provided on the opposite side of the remote module 12.

Figure 5:
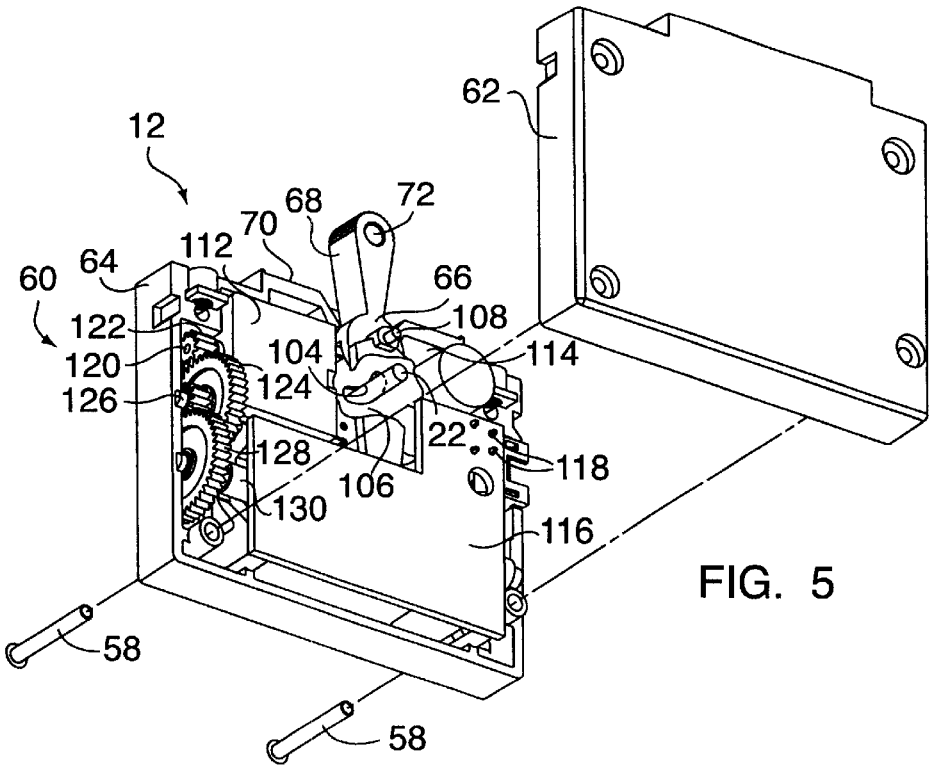
FIG. 5 is an exploded view of the interior of the remote module of FIG. 1.
Figure 6:
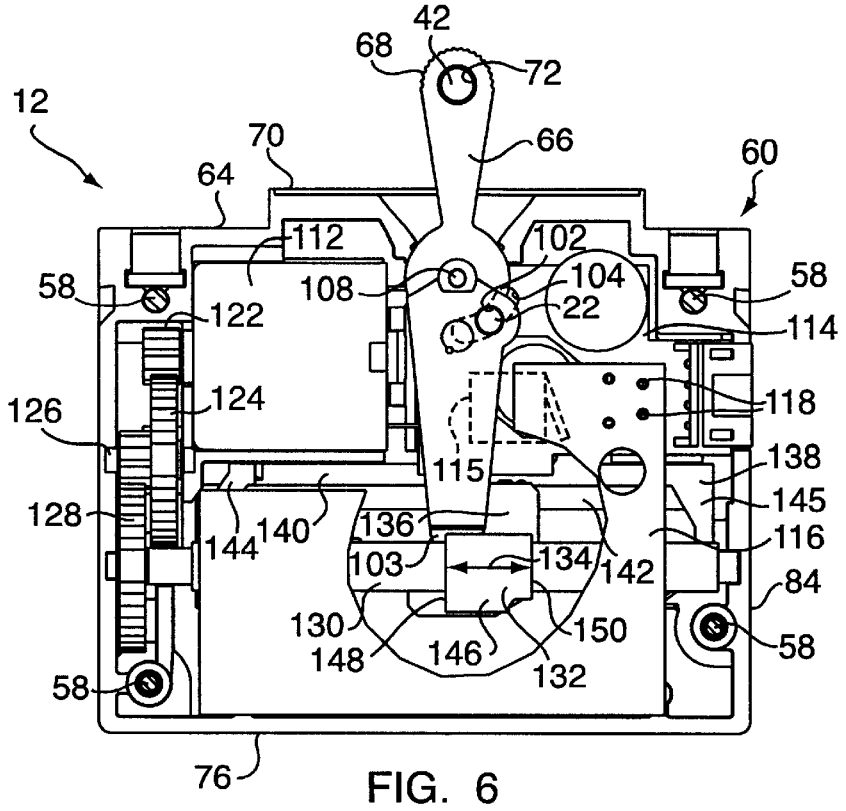
FIG. 6 is a perspective view of the interior of the remote module of FIG. 5.

Referring to FIGS. 5 and 6, the module actuator 66 includes the module handle 68 and a module tie pin hole 102 disposed on the module actuator 66 inside of the module housing 60. Additionally the module actuator 66 includes an actuator leg 103 (best seen in FIG. 7) extending inwardly into the plane of the drawing and substantially perpendicular to a lower distal end of the module actuator 66. The actuator tie pin 22 passes through a kidney shaped slot 104 defined in the side 106 of the remote module housing 60. The side 106 of the module housing 60 abuts the circuit breaker enclosure side 32. The kidney shaped slot 104 of the module housing 60 is aligned with the kidney shaped slot 50 of the circuit breaker enclosure 30 to receive the actuator tie pin 22 therethrough. The actuator tie pin 22 operationally connects the circuit breaker actuator link 36 to the module actuator 66 within the interior of the circuit breaker enclosure 30 and the module housing 60. The actuator tie pin 22 extends through each circuit breaker housing or pole so that all poles are driven by the motorized remote module 12. Note that FIGS. 5 and 6 show the motorized module 12 in an intermediate position to illustrate this operation.

A pivot pin 108 pivotally mounts the module actuator 66 to the interior of the module housing 60. A motor 112 is disposed in the module housing 60 and is electrically connected to a small printed circuit board 114. As will be discussed in greater detail hereinafter, a limit switch 115 is provided for controlling the direction of rotation of the motor 112. The switch 115 is located on the underside of the small printed circuit board 114 and electrically connected to the motor 112. The small printed circuit board 114 is electrically connected to a large printed circuit board 116 by a plurality of pin board connectors 118. The small printed circuit board 114 and the large printed circuit board 116 together provide voltage regulation and signal conditioning to the motor 112. Input power to the motor 112 is supplied through either the electrical terminals 74 or wire leads (not shown) connected to the small circuit breaker 114 through wire lead through holes 82. The motor 112 includes a motor shaft 120 with a motor gear 122 mounted axially thereon. The motor gear meshes with a double gear 124 which is pivotally mounted to the interior of the module housing 60 via a double gear pin 126.

The double gear 124 meshes with a lead screw gear 128 provided on a lead screw 130. Thus, motor 112 drives lead screw 130 at a reduced speed, providing a controlled force on lead screw car 132. The lead screw car 132 is internally threaded and non-rotatably held so that the lead screw 130 rotates and serves to position the lead screw car 132 along the length of the lead screw 130 as indicated by arrow 134. The lead screw car 132 has a generally cylindrical post 152 for pivotally supporting actuator catch 136. The catch 132 abuts the module actuator leg 103 to pivotally drive the module actuator 66. A limit switch lever 138 is disposed against an inside wall 142 of half shell 62 and includes a lever body 140 extending substantially parallel to the direction of travel of the lead crew car 132. The limit switch lever 138 also includes first and second lever handles 144 and 145 extending downwardly at substantially right angles from distal ends of the lever body 140. As will be discussed in greater detail herein below, when the car 132 reaches the extreme ends of its intended course of travel, it engages one of the lever handles 144, 145 to actuate the limit switch 115 and enable reverse direction of the motor 112.

Referring to FIG. 6, the lead screw car 132 has a generally rectangular car body 146, which includes a left side 148 and a right side 150 for engaging the first and second lever handles 144 and 145 respectively, depending on the direction of rotation of lead screw 130. The post 152 extends inwardly from a rear side 154 of the lead screw car 132 toward inside wall 142 to pivotally engage the actuator catch 136 through mounting hole 156. The actuator catch 136 is generally L shaped having a pair of legs 158 and 159 with a thickness which defines an inside edge 160 and an outside edge 161. Legs 158 and 159 respectively include a pair of inwardly extending positioning tabs 162 and 164. A plurality of cam structures 166 project outwardly from inside wall 142 to engage and guide the positioning tabs 162 and 164, and to pivot the actuator catch 136 substantially 180 degrees at the extreme distal ends of its travel. In operation, the cam structures 166 orient the inside edge 160 of the actuator catch 136 to always face toward the direction of travel. Due to this orientation, when the actuator catch 136 urges the module actuator 66 in a given direction, the module actuator 66 is always free to pivotally snap ahead to its limiting position without being impeded by the actuator catch 136.

The lever body 140 of limit switch lever 138 includes a bottom surface 167, which is slidably disposed upon an upper surface 168 of support shelf 170. Support shelf 170 projects outwardly from the inside wall 142 and extends substantially parallel to the direction of travel of the lead screw car 132. A generally rectangular limit switch stop 172 projects upwardly from an upper surface 174 of the support body 140 to engage the limit switch 115 (best seen in FIGS. 7, 8 and 9). A pair of generally concave cavities 176 and 177 are disposed proximate each other in the bottom surface 167 of the lever body 140 to define a resilient rib 178 therebetween. The cavities 176 and 177 are sized to receive a support self post 180, which projects upwardly from the upper surface 168 of the support shelf 170 and has a tapered arcuate outer surface.

Figure 7:
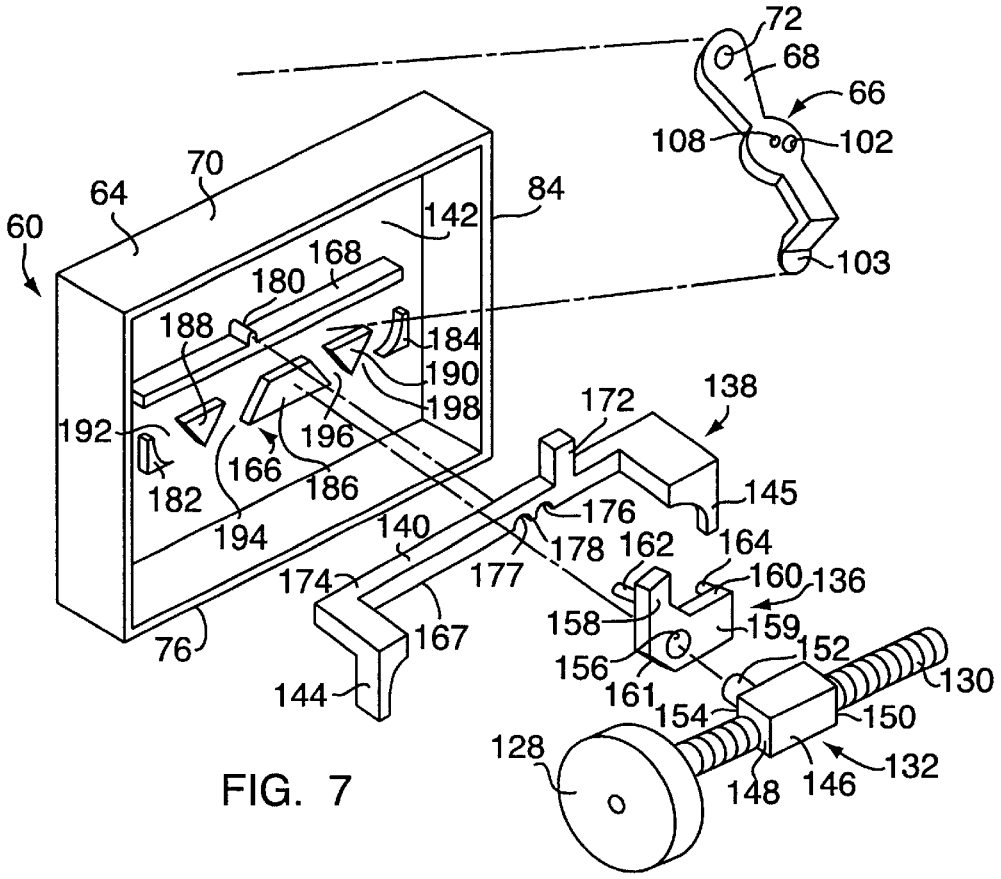
FIG. 7 is an exploded view of the interior of the remote module of FIG. 1 with the motor and printed circuit boards removed.
Figure 8:
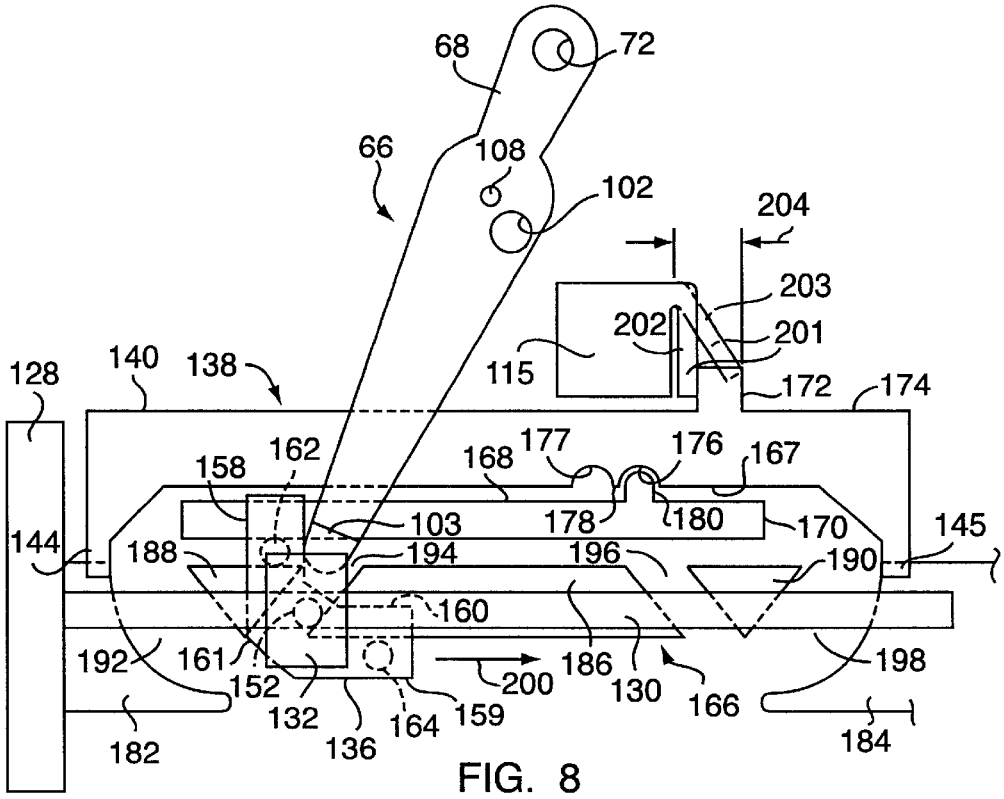
FIG. 8 is a perspective view of interior of the remote module showing the module actuator pivoted in a first extreme end position.

Referring to FIG. 7, the cam structures 166 include a pair of distally located crescent shaped cams 182 and 184, a centrally located trapezoidal cam 186, and a pair of triangular cams 188 and 190 located intermediate the crescent shaped cams 182, 184 and the trapezoidal cam 186. The cam structures 166 are disposed substantially parallel to the direction of travel of the actuator catch 136 and define a plurality of guide tracks 192, 194, 196 and 198 through which positioning tabs 162 and 164 traverse.

As the lead screw 130 first drives the lead screw car 132 from its extreme left limit toward the right, as indicated by directional arrow 200, the cam structures 166 guide the positioning tabs 162 and 164 to orient the actuator catch 136 as illustrated. The inside edge 160 of the actuator catch 136 abuts against the leg 103 of the module actuator 66 to urge the module actuator leg 103 in the direction of arrow 200, and to pivot the module actuator 66 in the counter clockwise direction about the pivot pin 108.

The limit switch 115, which is disposed on the small printed circuit board 114 (seen in FIG. 6), includes a spring loaded limit switch actuator 201. The actuator 201 includes a lever arm pivotally attached to the body of the limit switch 115, and having a closed 202 (shown in phantom) and an open 203 position. The closed and open positions have a predetermined distance 204 therebetween. When the limit switch actuator 201 is in the closed position 202, rotation of the motor 112 in a first direction is enabled. When the limit switch actuator 201 is in the open position 203, rotation of the motor 112 in an opposing second direction is enabled. Though the limit switch actuator 201 is shown in this embodiment as a lever arm, one skilled in the art will recognize that other actuating mechanisms may also be used to actuate the limit switch 115, e.g. a spring loaded push button.

The limit switch lever 138 is positioned such that the limit switch stop 172 depresses the limit switch actuator 201 into its closed 202 position. The support shelf post 180 of support shelf 170 is disposed within the cavity 176 of the limit switch lever 138 and abuts against the resilient rib 178 to releasably retain the limit switch actuator 201 in its closed 202 position.

Figure 9:
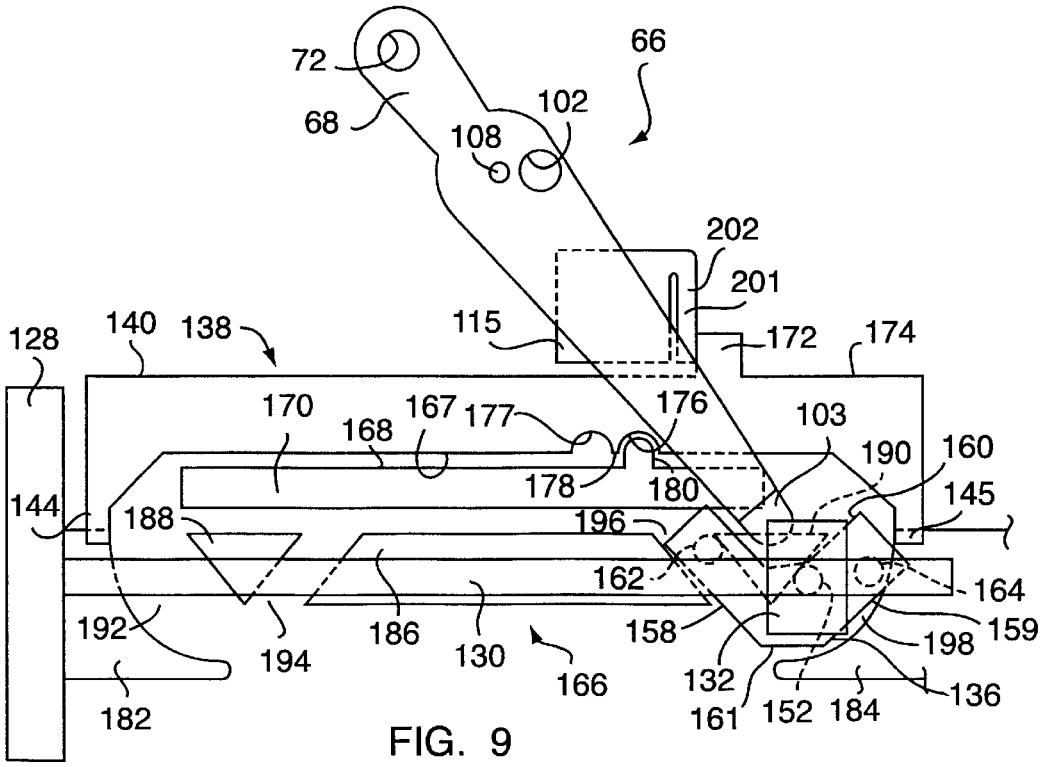
FIG. 9 is a perspective view of the interior of the remote module showing the module actuator pivoted in an intermediate position.

Referring to FIG. 9, as the module actuator 66 reaches the extreme limit of its pivotal counter clockwise travel, the lead screw 130 positions the lead screw car 132 and the actuator catch 136 over triangular cam 190. The module actuator leg 103 pulls on the actuator catch 136 to pivot the catch 136 about the post 152 of the lead screw car 132, and to urge the positioning tabs 162 and 164 of the catch 136 into guide tracks 196 and 198 respectively. The guide tracks 196 and 198 continue to pivot the actuator catch 136 about the post 152 until the catch 136 has completed a substantially 180 degree turn and the inside edge of the catch 136 now faces toward the left.

Figure 10:
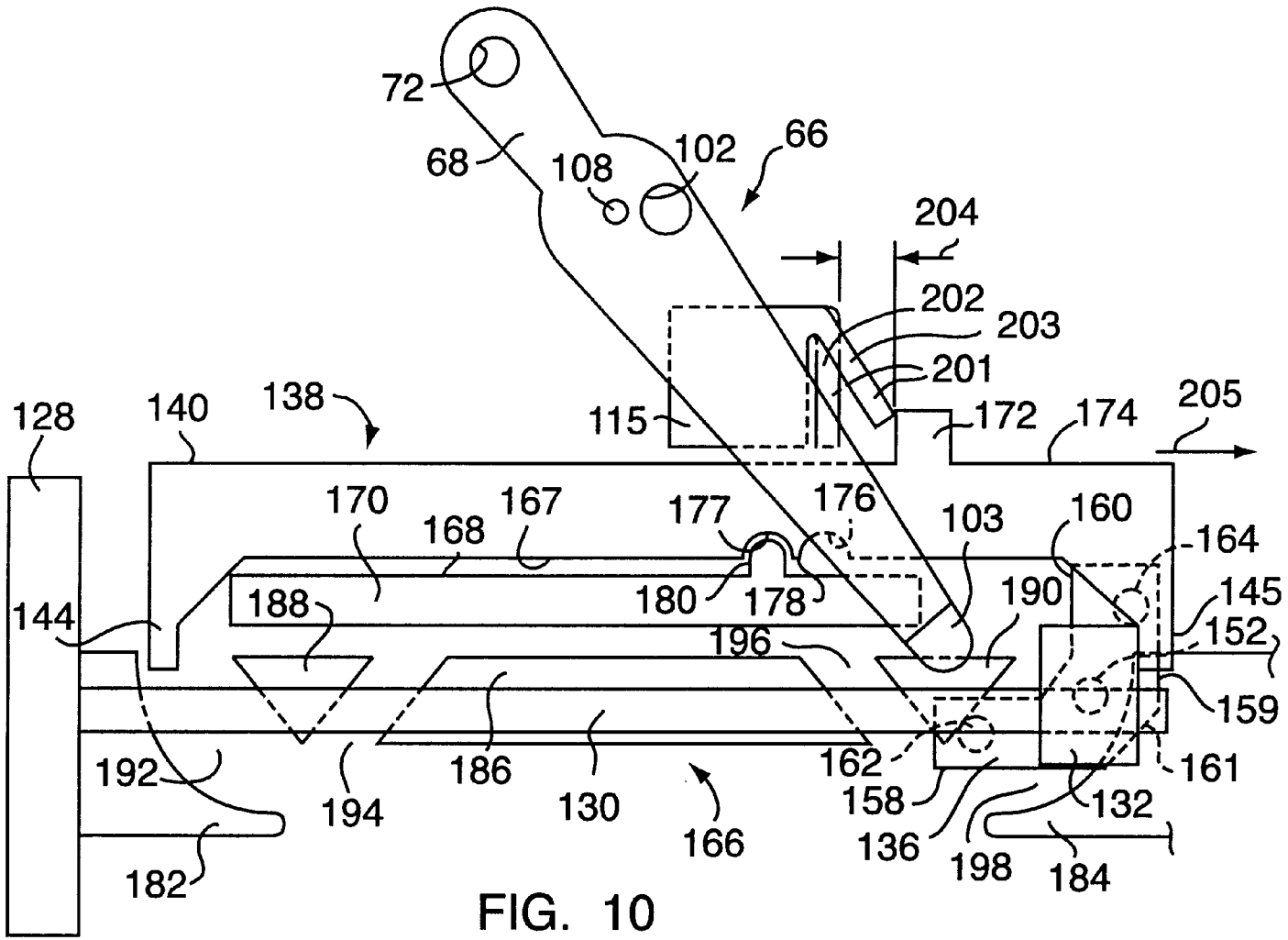
FIG. 10 is a perspective view of the interior of the remote module showing the module actuator pivoted in a second extreme end position.

Referring to FIG. 10, as the lead screw 130 drives the lead screw car 132 toward its extreme right limit, the right side surface 150 of the car 132 engages the downwardly extending second lever handle 145 of the limit switch lever 138 and urges the limit switch lever 138 toward the right as indicated by directional arrow 205. The tapered surface of the support shelf post 180 initially engages the resilient rib 178 as the limit switch lever 138 is first urged to the right. The resilient rib 178 is flexed back toward the left until the support shelf post 180 passes under the rib 178 with the rib snapping back to its original position to releasably retain the support shelf post 180 within the concave cavity 177. The cavities 177 and 178 are spaced a distance at least as large as the predetermined distance 204 between the closed 202 (shown in phantom) and open 203 positions of the limit switch actuator 201. Therefore, as support shelf post 180 passes from cavity 176 to cavity 177, the limit switch stop 172 is moved away for the limit switch actuator 201 a sufficient distance to allow the limit switch actuator 201 to snap into its open position 203, and stop the rotation of the motor 112 and lead screw 130. The limit switch lever 136, the lead screw car 132 and the actuator catch 136 are now positioned to pivot the module actuator 66 in the opposite, i.e., clockwise, direction when the motor 112 of the remote module 12 is activated again.

While preferred embodiments have been shown and described, various modifications and substitutions may be made thereto without departing from the spirit and scope of the invention. Accordingly, it is to be understood that the resent invention has been described by way of illustration and not limitation.

What is claimed is:

1. A motorized module for remote operation of a split case circuit breaker and comprising in combination:

a circuit breaker housing including split half sections defining a chamber therebetween, a movable contact in said chamber, a collapsible linkage in said chamber, an armature, a current/voltage sensing device in said chamber and including an electromagnetic sensing coil for moving said armature, said armature being coupled to said collapsible linkage for opening movement of the movable contact lever in response to a predetermined rise in the current/voltage sensed by said coil, a reset toggle pivotably mounted in said chamber and having one end coupled to said collapsible linkage, said toggle having a handle portion projecting through a top opening in said circuit breaker housing for resetting the collapsible linkage, a motorized module housing also having half sections defining a chamber therebetween said half sections defining a housing shape such that a top wall of both said circuit breaker housing and said motorized module housing are of the same geometrical configuration whereby the circuit breaker housing and motorized module housing are adapted to be assembled side by side with one another in a manner to that of the individual circuit breaker housing in a multi pole circuit breaker assembly of split case type circuit breakers, said motorized module chamber including a reversible drive motor, a lead screw, a captive nut adapted to be driven by the lead screw, a pivoted toggle having a portion coupled to said captive nut, and said toggle having a handle portion projecting through a top opening in said motorized module housing top wall, said circuit breaker toggle handle portion sharing a common pivot axis with said motorized module toggle handle so that said motor in said motorized module can operate the toggle in said circuit breaker from a remote location.

2. The combination according to claim 1 wherein said motorized module chamber further includes limit switches for stopping said electric motor and said captive nut in response to a predetermined travel of said nut on said lead screw and a limit switch lever pivotably mounted on said captive nut for sequentially resetting each of said limit switches in response to movement of said captive nut on said lead screw to limit positions corresponding to a predetermined angular range of travel for said toggle.

3. The combination according to claim 2 wherein said motorized module chamber further includes a shifting shelf coupled to said lever and having spaced abutments for so resetting said limit switches in response to said limit switch lever movement.

4. The combination according to claim 1 wherein said actuator is pivotably mounted in said motorized module housing has its lower portion coupled to said captive nut by a lost motion mechanism, said lost motion mechanism including a pivoted bell crank lever having angularly spaced pins for entrapping the lower end of the motorized module toggle, and limit switches defining limits of travel for said captive nut and bell crank lever by interrupting current to said motor in said motorized module chamber.

5. An assembly comprising of at least one circuit breaker, said at least one circuit breaker including a generally rectangular enclosure having one side and an opposite side, and a top surface, a circuit breaker actuator pivotably mounted inside the circuit breaker enclosure, a motorized module for remote operation of the circuit breaker, said motorized module including a housing mounted to one side of the circuit breaker enclosure and having a generally congruent geometric shape with respect to the circuit breaker enclosure particularly with respect to the top wall thereof, and an electric motor in the motorized module housing, a module actuator pivotably mounted inside said module housing, coupling means for coupling the electric motor to the actuator said coupling including a limit switch having an actuator with a closed position for enabling rotation of the motor in the first direction and an open position for enabling rotation in the opposite or second direction, said closed and opened position having a predetermined linear distance therebetween, a limit switch lever and a support shelf therefor, said support shelf having a post for releasably retaining the limit switch lever in a first position corresponding to a limit switch actuator closed position, said support shelf post being releasably retained in said first position, and adapted to shift to a second position such that the limit switch actuator is provided in an open position corresponding to said second position for the limit switch actuator, said shelf post being alternatively retained in said first and second cavities by said limit switch lever as a result of a resilient rib provided between said cavities whereby said rib flexes to achieve shifting of said support shelf pole of movement in alternate directions in said motorized module housing.

6. The combination according to claim 5 further comprising a lead screw operatively connected to the electric motor in said motorized module, a lead screw car threadably engaged with the lead screw so that the lead screw car travels along the lead screw from a first to a second position and returns, and said limit switch lever having spaced abutment surfaces, and said lead screw car having a pivoted catch with projecting pins for engagement with said spaced abutment surfaces of said limit switch lever, said projecting pins being further engageable with the motorized module actuator link for providing a lost motion coupling therewith, and means for coupling said circuit breaker actuator to said motorized module actuator.

7. The combination according to claim 6 further characterized by fixed cams defined in the interior side wall of said motorized module housing to cause said catch pivotably mounted on said car to pivot through a substantial angle as the lead screw car reaches limits of its travel in said housing.

8. The combination according to claim 6 further characterized by a limit switch provided on said limit switch lever for selective engagement with said limit switch whereby a single limit switch can be used in conjunction with associated circuitry to stop the travel of the lead screw car, and sequentially allow movement in an opposite direction once the lead screw car has stopped movement in one direction.

9. The combination according to claim 7 wherein said actuator coupling compromises a pin provided within said circuit breaker and motorized modular housing, and extending through a slotted opening defined in the adjacent side wall of the side-by-side circuit breaker and motorized module housings.

10. The combination according to claim 8 wherein said circuit breaker actuator and motorized modular actuator are coupled by an external pin provided in the toggles which project from the housing of said circuit breaker and motorized module.

* * * * *